US011649081B2

(12) United States Patent
Cere'

(10) Patent No.: US 11,649,081 B2
(45) Date of Patent: May 16, 2023

(54) WRAPPING MACHINE

(71) Applicant: AETNA GROUP S.P.A., Verucchio (IT)

(72) Inventor: Mauro Cere', Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 387 days.

(21) Appl. No.: 16/631,967

(22) PCT Filed: Jul. 18, 2018

(86) PCT No.: PCT/IB2018/055341
§ 371 (c)(1),
(2) Date: Jan. 17, 2020

(87) PCT Pub. No.: WO2019/016729
PCT Pub. Date: Jan. 24, 2019

(65) Prior Publication Data

US 2020/0165018 A1 May 28, 2020

(30) Foreign Application Priority Data

Jul. 20, 2017 (IT) ..... 102017000082745

(51) Int. Cl.
*B65B 11/02* (2006.01)

(52) U.S. Cl.
CPC ..... *B65B 11/025* (2013.01); *B65B 2210/18* (2013.01)

(58) Field of Classification Search
CPC ..... B65B 11/025; B65B 2210/18
(Continued)

(56) References Cited

U.S. PATENT DOCUMENTS 3,583,310 A * 6/1971 Blough ..... B21C 47/245 100/26
4,587,796 A * 5/1986 Haloila ..... B65B 11/025 53/176

(Continued)

FOREIGN PATENT DOCUMENTS

CN 104203753 12/2014
CN 104401522 3/2015

(Continued)

OTHER PUBLICATIONS

International Search Report dated Sep. 25, 2018 in International (PCT) Application No. PCT/IB2018/055341.

(Continued)

*Primary Examiner* — Robert F Long
*Assistant Examiner* — Xavier A Madison
(74) *Attorney, Agent, or Firm* — Wenderoth, Lind & Ponack, L.L.P.

(57) ABSTRACT

A wrapping machine for wrapping a load with a plastic film includes a main frame with two supporting columns having upper portions interconnected by a beam, a supporting carriage slidingly supported by the main frame and moved along a working direction by first actuating device, a moving ring rotatably supported by the supporting carriage and rotatably driven by second actuating device around a wrapping axis parallel to the working direction, and an unwinding unit fixed to the moving ring and provided with a reel of film and rollers. The first actuating device includes a first actuator arranged to operate a driving shaft rotatably supported by the beam and provided with a driving pulley engaged to a flexible element connected to the supporting carriage. The driving pulley rotates with the driving shaft for moving the flexible element and therefore the supporting carriage along the working direction.

9 Claims, 3 Drawing Sheets

(58) Field of Classification Search
USPC ..... 53/588
See application file for complete search history.

(56) References Cited

U.S. PATENT DOCUMENTS

| | | | | |
|---|---|---|---|---|
| 5,787,691 | A | 8/1998 | Turfan et al. | |
| 7,213,381 | B2 * | 5/2007 | Zitella | B65B 13/181 53/139.7 |
| 2004/0226266 | A1 * | 11/2004 | Suolahti | B65B 11/025 53/428 |
| 2014/0123605 | A1 * | 5/2014 | Cere' | B65B 11/025 53/461 |
| 2018/0050832 | A1 * | 2/2018 | Hurme | B65B 57/12 |
| 2021/0047060 | A1 * | 2/2021 | Cere' | B65B 11/585 |

FOREIGN PATENT DOCUMENTS

| | | |
|---|---|---|
| CN | 106742162 | 5/2017 |
| EP | 1 454 827 | 9/2004 |
| WO | 2008/117161 | 10/2008 |
| WO | 2010/131945 | 11/2010 |

OTHER PUBLICATIONS

Office Action dated Mar. 24, 2021 in corresponding Chinese Patent Application No. 201880048028.9, with English Translation.

* cited by examiner

WRAPPING MACHINE

The invention concerns machines for wrapping a load with a cold-stretchable plastic film or wrap and, in particular, concerns a wrapping machine with horizontal rotating-ring.

The known wrapping machines with horizontal rotating-ring comprise a main frame to which a secondary frame or supporting carriage is slidably connected, arranged for rotatably supporting a ring structure, or ring, to which a film unwinding equipment is attached.

The ring rotates about a vertical wrapping axis, while the supporting carriage linearly moves along a line parallel to the wrapping axis. In doing so, the film unwinding equipment is movable along, and about, the wrapping axis while the load to be wrapped remains fixed.

The unwinding equipment houses and supports a reel of film and is generally provided with a pair of pre-stretching rollers which unwind the film from the reel and stretch or elongate it, and one or more return rollers that divert the film towards the load. The latter is typically composed of one or more products grouped and arranged on a pallet.

The film unwound from the reel is wrapped around the load in such a way as to form a series of intertwined strips or bands of a helical shape thanks to the combination of the linear movement and the rotation of the unwinding equipment.

Suitable actuating means is provided for the vertical movement of the carriage and therefore of the ring, which comprises an electric motor that is located on the top of the main frame and acts on the carriage by means of suitable transmission means.

The placement of the electric motor on the top of the main frame prevents cluttering the lower part or base of the wrapping machine and allows for free movement of the load, its wrapping and the carrying out of operations on the film and/or load (fixing the end of the film, insertion of angular elements to protect corners, etc.). At the same time, its elevated position makes it possible to simplify the structure of the transmission means connecting the electric motor to the supporting carriage.

A disadvantage of this solution lies in the fact that carrying out maintenance on the engine and the transmission means is awkward and inconvenient for the operator, who must place himself at the top of the main frame. In some cases, for safety requirements imposed by national regulations, appropriate supporting structures such as platforms or balconies must be provided on the main frame which allow the operator to safely access and work on the engine and the transmission means.

However, in addition to being expensive these supporting structures are bulky and prevent, for example, closer placement of multiple wrapping machines in a line.

Document EP 1454827 illustrates a wrapping machine provided with a fixed frame that is supported by a base comprising four upright vertical columns along which a lifting frame is vertically movable, moved by a lifting motor. The lifting frame rotatably supports a supporting ring that is driven by a rotating motor to which a al quale is fixed a unit for supplying a wrapping film. The lifting motor 6 of the lifting frame and the rotary motor of the supporting ring are placed on the lifting frame.

An object of the invention is to improve the known wrapping machines arranged to wrap a load with a film of plastic material, in particular wrapping machines provided with a horizontal rotating ring fixed to a vertically movable supporting carriage.

Another object is to realize a wrapping machine provided with actuating means of the supporting carriage which is easily and conveniently accessible by an operator and at the same time reliable and safe.

A further object is to realize a wrapping machine which has a reduced overall size in plan view and allows for different arrangements in relation to the forward direction of the loads to be wrapped.

These and other objects are achieved by a wrapping machine according to one or more of the following claims.

The invention can be better understood and implemented with reference to the attached drawings that illustrate an embodiment, by way of non-limiting-example, wherein.

Figure 1:
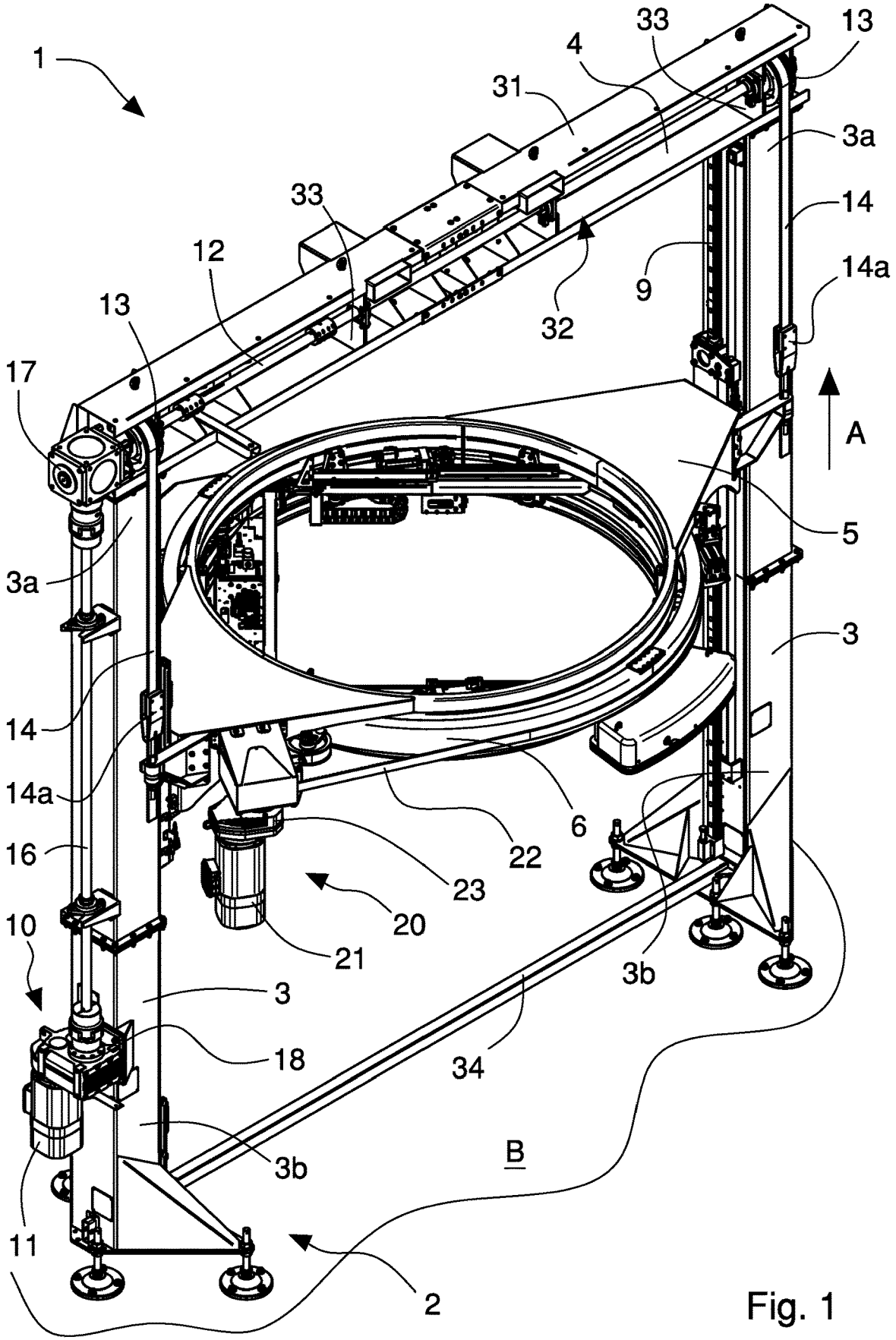
FIG. 1 is a schematic perspective view of the wrapping machine according to the invention.
Figure 2:
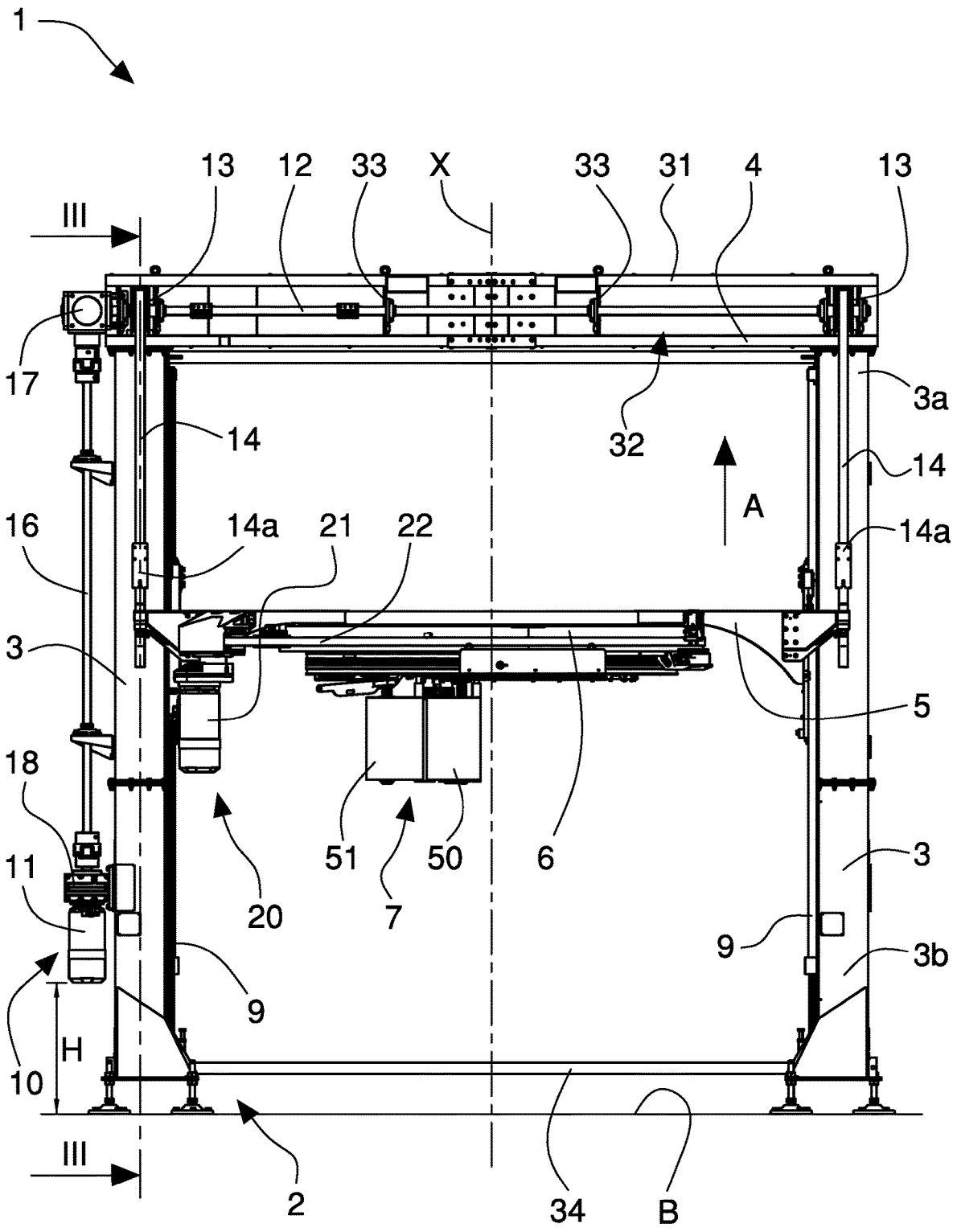
FIG. 2 is a front view of the wrapping machine of FIG. 1.
Figure 3:
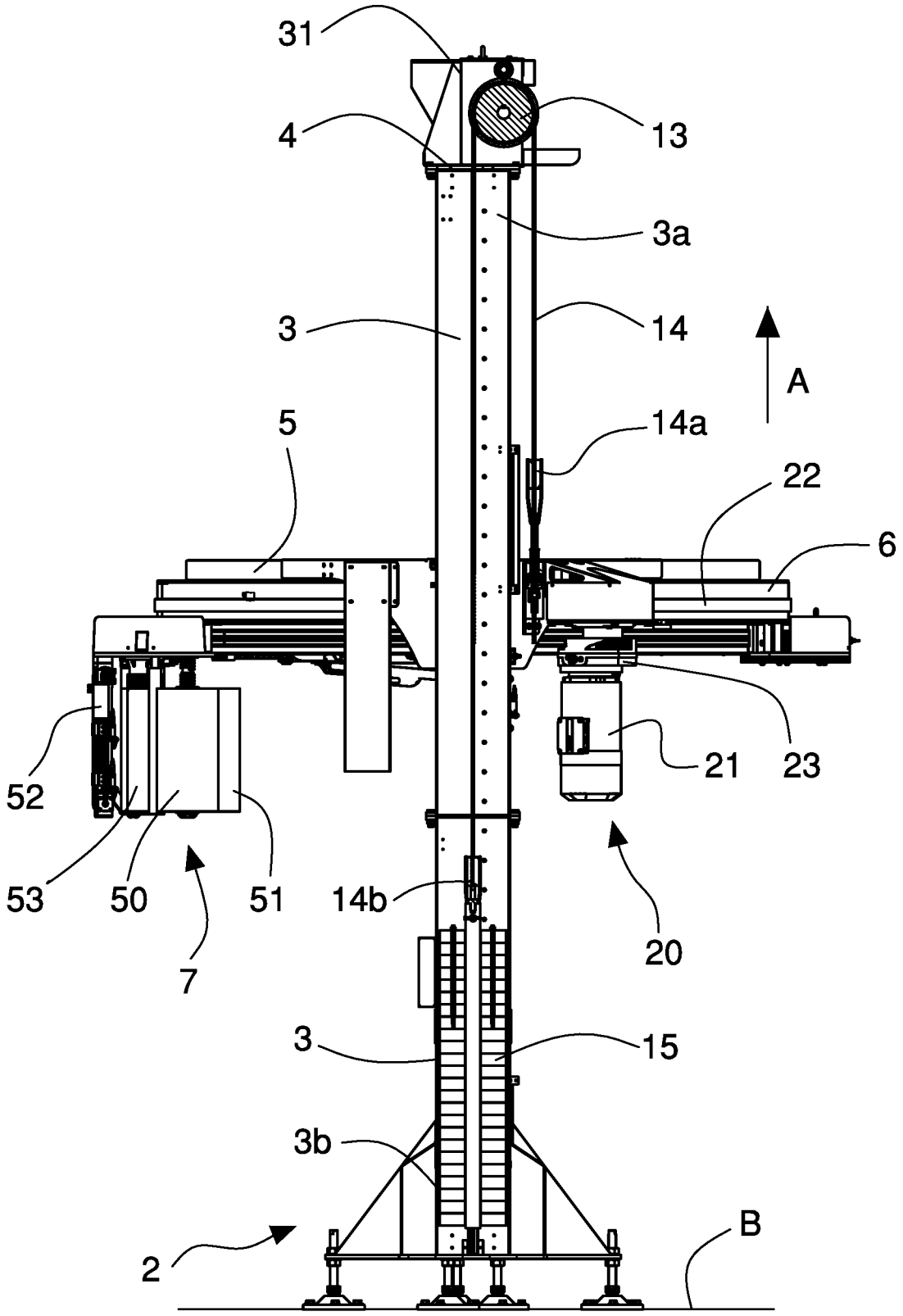
FIG. 3 is an enlarged sectional view along the line III-III of FIG. 2.

With reference to FIG. 1, a wrapping machine 1 according to the invention is schematically illustrated, arranged to wrap a load, not illustrated, with a plastic film 50, in particular a cold-stretchable plastic film.

The wrapping machine 1 comprises a main frame 2 provided with at least two supporting columns 3, for example two, having respective upper portions 3*a* interconnected by beam means 4, and a supporting carriage 5 slidably supported by the main frame 2 and moved by first actuating means 10 along a working direction A, in particular substantially vertical.

The main frame 2 is also provided with a connecting tie rod 34 which connects the two lower portions 3*b* of the supporting columns 3 so as to structurally stabilise and strengthen the aforesaid main frame 2.

A moving ring 6 is rotatably supported by the supporting carriage 5, or carriage, and is driven by second actuating means 20 rotatably around a wrapping axis X that is parallel to the working direction A. The moving ring 6, or ring, is therefore arranged horizontally, parallel to a supporting plane B of the wrapping machine 1.

The latter comprises at least one unwinding unit 7 fixed to the moving ring 6 and provided with a reel 51 of film 50 and with roller means 52, 53 for unwinding and pre-stretching the film 50. More precisely, the unwinding unit 7 comprises a pair of pre-stretching rollers 52, 53, which unwind the film 50 from the reel 51 and stretch or lengthen it, and one or more return rollers that divert the film 50 toward the product or group of products forming the load to be wrapped.

The first actuating means 10 comprises a first actuator 11 mounted on said main frame 2 at a lower portion 3*b* of one of the supporting columns 3 at a defined distance H from the supporting plane B of the wrapping machine 1. In particular, in the embodiment illustrated in the figures, the first actuator 11 is directly mounted on, and fixed to, a lower portion 3*b* of one of the supporting columns 3. Alternatively, the first actuator 11 can be mounted on, and fixed to, the connecting tie rod 34, at a lower portion 3*b* of one of the supporting columns 3.

The first actuator 11 is arranged to actuate in rotation a driving shaft 12 about a respective longitudinal axis. The latter is rotatably supported by the beam means 4 and is provided with at least one driving pulley 13 engaged with a flexible element 14 connected to the carriage 5.

The driving pulley 13, by rotating with the driving shaft 12 actuated by the first actuator 11, moves the flexible element 14 and therefore the carriage 5 along the working direction A.

More precisely and in the illustrated embodiment, the flexible element 14 comprises a first end 14*a* fixed to the supporting carriage 5 and a second end 14*b* fixed to a counterweight 15 slidably housed within one of the supporting columns 3, in particular inside the supporting column 3 where the driving pulley is located.

In the embodiment illustrated in the figures, the driving shaft 12 comprises a pair of driving pulleys 13 positioned at opposite ends of the aforesaid driving shaft 12 and at the supporting columns 3.

The driving pulleys 13 are engaged by, and move, respective flexible elements 14 having first end 14*a* connected to the carriage 5 and second end 14*b* connected to respective counterweights 15, each of which is slidably housed within a corresponding supporting column 3.

Each flexible element 14 comprises a toothed belt or a chain that engages or meshes with the corresponding driving pulley 13 provided with suitable teeth.

In a variant of the wrapping machine 1 of the invention, which is not shown in the figures, the first actuating means 10 of the supporting carriage 5 does not comprise counterweights, but at least one flexible element which is closed in a ring and wound around the respective driving pulley and around an opposite return pulley, for example housed in the lower portion 3*b* of the respective supporting column 3. The supporting carriage 5 is therefore attached to the flexible element at one of its two straight segments interposed between the two driving pulleys and return pulleys and moves with it along the working direction A.

In another variant of the wrapping machine of the invention, which is not shown, the first actuating means 10 of the supporting carriage 5 does not comprise counterweights, but at least one flexible element in the form of a chain that winds with the teeth of the respective driving pulley and comprises a first end fixed to the supporting carriage 5 and a second free end which rests with its own weight on the opposite side with respect to the driving pulley.

The first actuating means 10 further comprises connecting means 16, 17 to connect or mechanically connect the first actuator 11 to the driving shaft 12. The connecting means comprises, for example, a transmission shaft 16 and an angular gearbox 17. The transmission shaft 16 is almost parallel to the working direction A and fixed to the supporting column 3, which supports the first actuator 11, so as to rotate about a respective longitudinal axis. The transmission shaft 16 connects the first actuator 11 to the angular gearbox 17, which is in turn connected to the driving shaft 12.

The first actuator 11 comprises a rotary electric motor able to rotate the transmission shaft 16 and therefore the driving shaft 12 and the driving pulleys 13.

A speed reducer 18 of the first actuating means 10 is mounted on the main frame 2, at the lower portion 3*b* of the supporting column 3, interposed between the first actuator 11 and the transmission shaft 16 to reduce and control the speed of rotation of the latter and hence of the carriage 5.

In a variant of the wrapping machine 1, which is not illustrated, the first actuator can comprise a gearmotor wherein the electric motor and the speed reducer are integrated in a single unit.

In the embodiment illustrated in the figures, the first actuator 11, provided with the speed reducer 18, and the transmission shaft 16 are attached to an outer side of the supporting column 3, on the opposite side with respect to an inner zone of the wrapping machine where the load is wrapped.

However the first actuator 11 and the transmission shaft 16 can be fixed to a side of the supporting column 3 closest to the inner zone of the machine in order to limit the external dimensions of the latter.

It should be noted that the first actuator 11 and the speed reducer 18 are positioned at a predetermined height H from the ground that allows an operator to easily access them for maintenance without the need to use ladders, scaffolding or similar. This significantly reduces the time required to carry out operations on the first actuator 11 and the speed reducer 18 and limits the risks to the operator's safety.

In a version of the wrapping machine 1 of the invention, that is not illustrated, the connecting means of the first actuating means 10 can comprise, for instance, a toothed belt or a chain which connect a first toothed pulley or wheel, mounted on the driving shaft 12, to a second toothed pulley or wheel driven by the first actuator 11 or by the speed reducer 18 driven by the latter.

The carriage 5 is slidably mounted on the supporting columns 3 by means of guide means 9 of a known type which enables the translational motion of the carriage 5 and the ring 6 along the vertical working direction A in both directions with reduced friction.

The second actuating means 20 comprises a second actuator 21 mounted on the carriage 5 and arranged to operate or rotate the ring 6 by means of belt means 22. More precisely, the second actuator 21 comprises a respective rotary electric motor which rotates, through a further speed reducer 23, a driving pulley engaged to a belt of the belt means 22, which can be wrapped around the ring 6.

The beam means comprises a straight beam 4, for example provided with a casing 31 defining a compartment 32 adapted to receive the driving shaft 12 and the driving pulleys 13. A plurality of supporting elements 33 are fixed to the beam 4, in particular inside the casing 31, for rotatably supporting the driving shaft 12.

The portal structure of the main frame 2, provided with two supporting columns 3 which are opposite and facing each other, makes it possible to position the wrapping machine 1 with the supporting columns 3 adjacent to a supporting table or to a load conveyor, i.e. with the main frame 2 (i.e. the beam 4 and the tie rod 34) inclined or oblique with respect to a forward direction of the load through the machine 1.

With this inclined placement, it is possible to place multiple wrapping machines 1 side by side in a line while minimising the overall dimensions.

In a version of the wrapping machine 1 of the invention, which is not illustrated, the main frame 2 can include three or four supporting columns 3, in this case with the beam means comprising a plurality of beams fixed to the upper portions of the supporting columns and mutually interconnected to form an upper connecting frame.

The invention claimed is:

1. A wrapping machine for wrapping a load with a film of plastic material, the wrapping machine comprising:

a main frame provided with at least two supporting columns that have respective upper portions interconnected by a beam;

a supporting carriage slidably supported by said main frame and moved by a first driving device along a working direction;

a moving ring that is rotatably supported by said supporting carriage and driven by a second driving device rotatably around a wrapping axis that is parallel to the working direction;

an unwinding unit fixed to said moving ring and configured to support a reel of the film, said unwinding unit including rollers for unwinding and pre-stretching the film, wherein said first driving device comprises a first actuator that is mounted on said main frame at a lower portion of one of said supporting columns at a defined distance from a supporting plane of said wrapping machine and is arranged to actuate a driving shaft, which is orthogonal to the working direction, rotatably supported by said beam and provided with at least one driving pulley that is engaged with a flexible element connected to said supporting carriage, wherein said driving pulley, by rotating with said driving shaft actuated by said first actuator, is configured to move said flexible element and therefore said supporting carriage along the working direction, wherein said first driving device further comprises a connecting system arranged for connecting said first actuator to said driving shaft, said connecting system including a transmission shaft and an angular gearbox, wherein said transmission shaft is parallel to the working direction and connects said first actuator to said angular gearbox and said angular gearbox is connected to said driving shaft, wherein said flexible element has a first end that is fixed to said supporting carriage and a second end fixed to a counterweight, and wherein said counterweight is slidably housed within one of said supporting columns.

2. The wrapping machine according to claim 1, wherein said first actuator is fixed to said lower portion of said one of said supporting columns.

3. The wrapping machine according to claim 1, wherein said at least one driving pulley is a pair of driving pulleys that are positioned at opposite ends of said driving shaft at said supporting columns, and are engaged by respective flexible elements.

4. The wrapping machine according to claim 3, wherein said flexible elements have respective first ends connected to said supporting carriage and respective second ends connected to respective counterweights, wherein each of said counterweights is slidably housed within a respective one of said supporting columns.

5. The wrapping machine according to claim 1, wherein said flexible element comprises a toothed belt or a chain.

6. The wrapping machine according to claim 1, wherein said first actuator comprises a rotary electric motor.

7. The wrapping machine according to claim 1, wherein said first driving device further comprises a speed reducer mounted on said main frame at said lower portion of said one of said supporting columns and interposed between said first actuator and said transmission shaft.

8. The wrapping machine according to claim 1, wherein said supporting carriage is slidably mounted on said supporting columns by a guiding arrangement.

9. The wrapping machine according to claim 1, wherein said second driving device comprises a second actuator mounted on said supporting carriage and arranged to drive said moving ring by a belt.

* * * * *